US006933834B2

(12) United States Patent
Diggins, Jr.

(10) Patent No.: US 6,933,834 B2
(45) Date of Patent: Aug. 23, 2005

(54) DUE-DATE ALARM FOR RENTED ITEMS SUCH AS VIDEO CASSETTES AND DVDS

(76) Inventor: Paul J. Diggins, Jr., 23722 Barquilla, Mission Viejo, CA (US) 92691

( * ) Notice: Subject to any disclaimer, the term of this patent is extended or adjusted under 35 U.S.C. 154(b) by 389 days.

(21) Appl. No.: 10/290,033

(22) Filed: Nov. 6, 2002

(65) Prior Publication Data

US 2003/0227372 A1 Dec. 11, 2003

Related U.S. Application Data

(60) Provisional application No. 60/337,696, filed on Nov. 6, 2001.

(51) Int. Cl.[7] ..... G08B 1/00
(52) U.S. Cl. ..... 340/309.16; 368/10
(58) Field of Search ..... 340/309.16; 368/1, 368/10

(56) References Cited

U.S. PATENT DOCUMENTS

| | | | | | |
|---|---|---|---|---|---|
| 4,814,901 | A | * | 3/1989 | Onishi et al. | 386/46 |
| 4,853,682 | A | * | 8/1989 | Asano et al. | 345/169 |
| 5,294,915 | A | * | 3/1994 | Owen | 340/539.32 |
| 5,619,477 | A | * | 4/1997 | Schenk | 368/10 |
| 5,625,334 | A | * | 4/1997 | Compton | 340/309.7 |
| 5,646,912 | A | * | 7/1997 | Cousin | 368/10 |
| 6,091,326 | A | * | 7/2000 | Castellano | 340/457.4 |
| 6,392,961 | B1 | * | 5/2002 | Chiam et al. | 368/47 |
| 6,483,779 | B1 | * | 11/2002 | Teixeira | 368/10 |

* cited by examiner

*Primary Examiner*—John Tweel, Jr.
(74) *Attorney, Agent, or Firm*—Eric K. Satermo

(57) ABSTRACT

An electronic device such as an alarm that reminds a user when rented items or products such as video cassettes or digital versatile discs (DVDs) are due back to the rental store, or when a library book is due back at a library.

31 Claims, 10 Drawing Sheets

DUE-DATE ALARM FOR RENTED ITEMS SUCH AS VIDEO CASSETTES AND DVDS

CROSS REFERENCE TO RELATED APPLICATION

The present application claims priority of Provisional Application for Patent Ser. No. 60/337,696 filed Nov. 6, 2001.

BACKGROUND OF THE INVENTION

The present invention provides an electronic device such as an alarm that reminds a user when rented items or products such as video cassettes or digital versatile discs (DVDs) are due back to the rental store, or when a library book is due back at a library.

One unpleasant experience of renting media such as video cassettes, DVDs, and library books is paying a late fee when the item is returned past its due date. From the point of view of the retailer, negative publicity is often associated with the large incomes associated with late fees.

Accordingly, there is a need in the art for a device that alerts the consumer when the due date of a rented item is approaching.

SUMMARY OF THE INVENTION

The present invention provides an electronic device such as an alarm that reminds a user that the due date and time is approaching on a rented item.

DETAILED DESCRIPTION OF THE INVENTION

Figure 1:
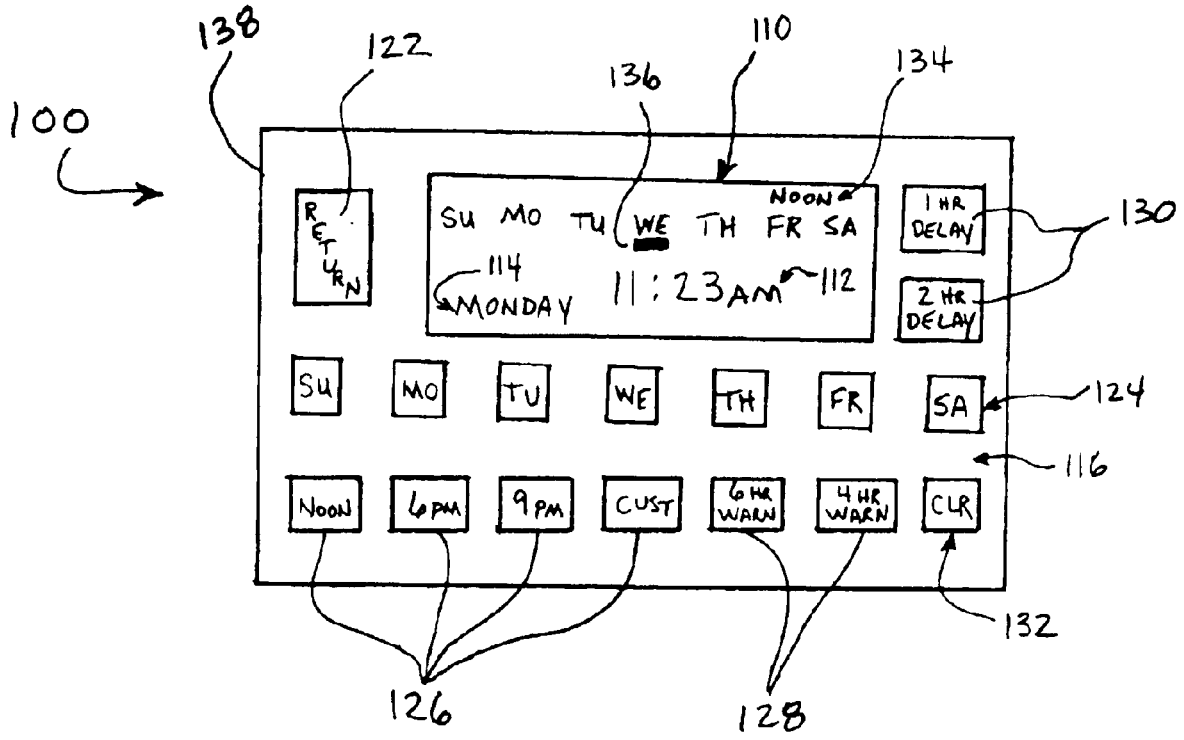
FIG. 1 is a plan view of an alarm.

As shown in the drawings, an electronic device 100 such as an alarm that reminds a user when a rented item such as a video cassette or a digital versatile disc (DVD) is due back to the rental store. More specifically, the alarm 100 provides a warning signal prior to a due date of a rental item. For example, if a rented DVD is due back to the store at noon on Wednesday, then the alarm 100 will provide a warning signal, e.g., an audible signal or a visible signal, prior to noon on Wednesday so that the renter has sufficient time to return the DVD to the store. In a number of embodiments, the warning signal is provided at a time prior to the due date that is equal to a predetermined amount of time, or a warning lead time, which is discussed in more detail below.

Figure 2:
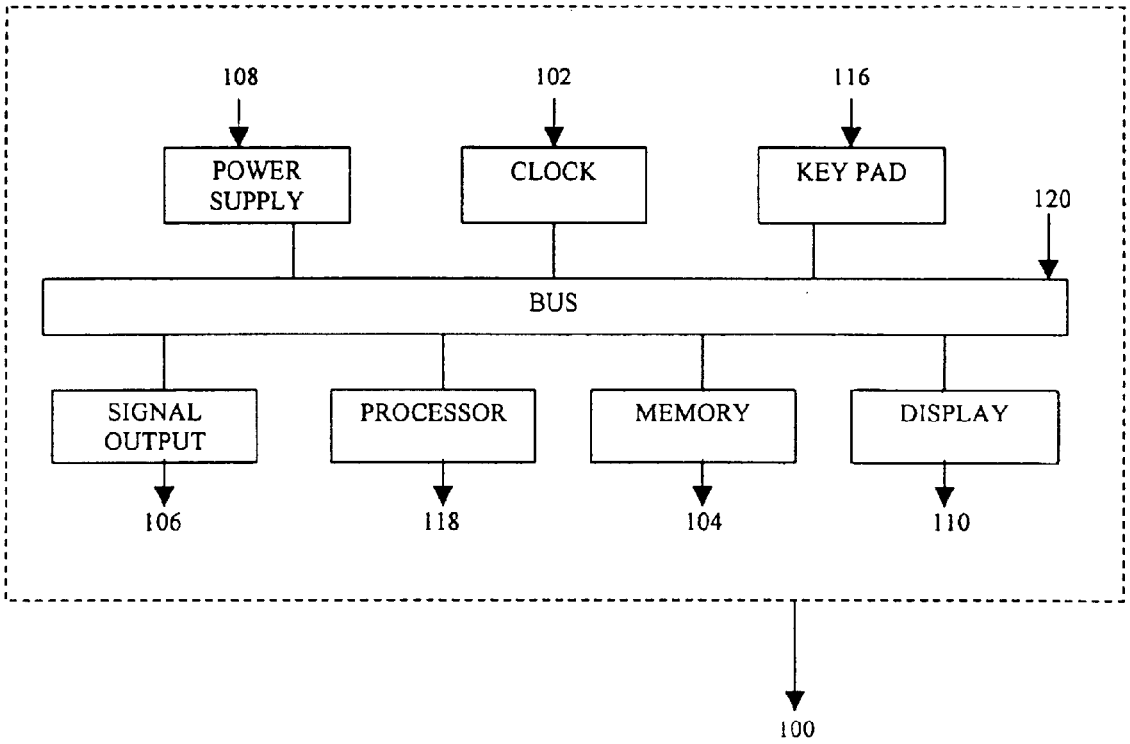
FIG. 2 is a schematic view of an alarm.

Referring to FIGS. 1 and 2, in a number of embodiments the alarm 100 may include a clock 102, a memory 104, a signal output 106, a power supply 108 such as a battery, a display 110 for showing the time 112 and the day 114 of the week, and a keypad 116. In addition, the alarm 100 may include a processor 118 connected to the clock 102, the memory 104, the signal output 106, the power supply 108, the display 110, and the keypad 116, for example, via a bus 120.

Figure 3:
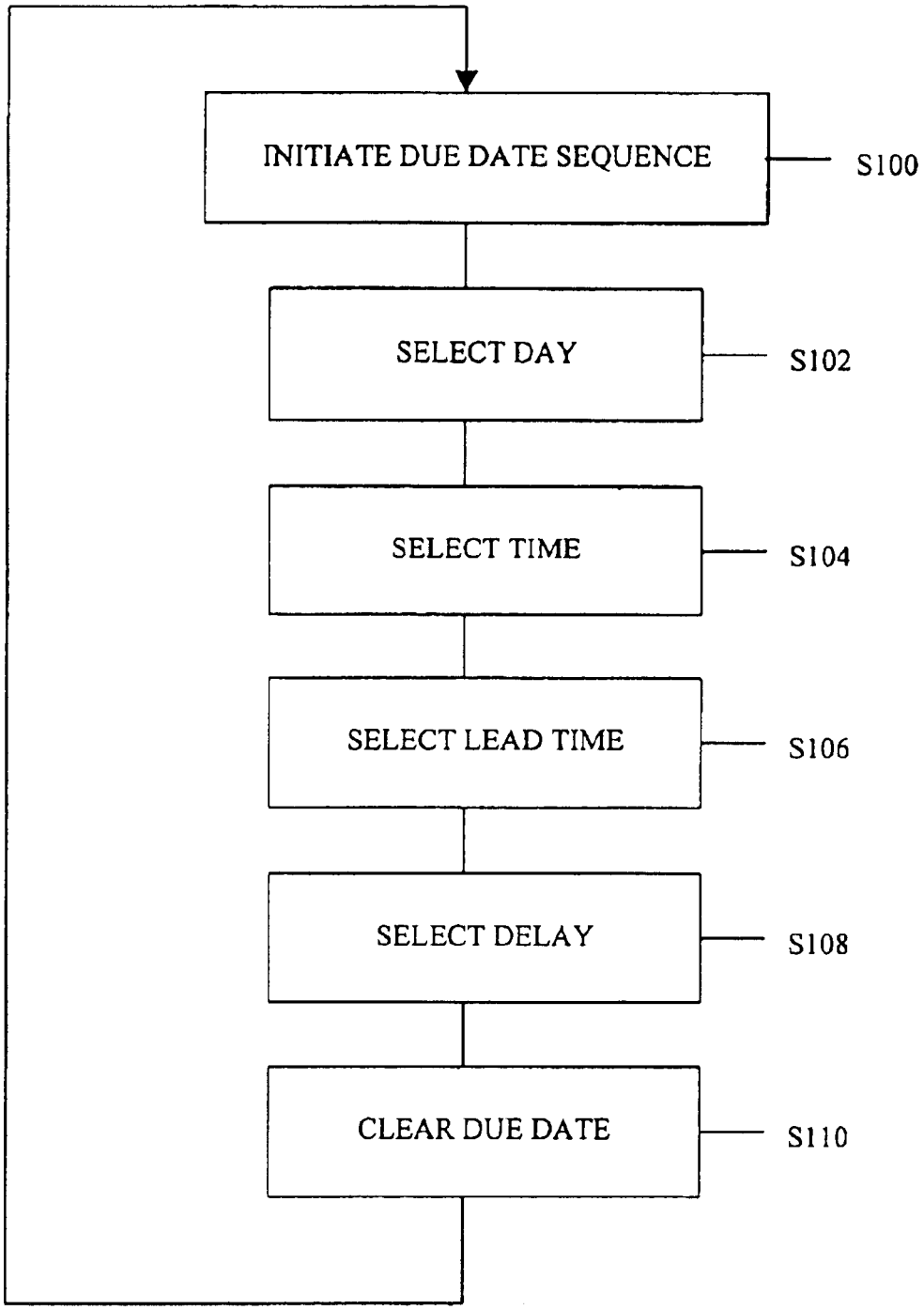
FIG. 3 is a flow chart of methodology of a due-date sequence.

In some of the embodiments, the keypad 116 may include a key 122 for initiating a due-date sequence. With additional reference to FIG. 3, when the initiate key 122 is actuated, a due-date sequence is initiated (step S100). To enter the due date, a key 124 for selecting a day of the week of the due date may be actuated (step S102). In a number of embodiments, such as shown in FIG. 1, the keypad 116 may include a plurality of keys 124 each corresponding to a day of the week day.

To enter the time of the due date, a key 126 for selecting a time of day of the due date may be actuated (step S104). In a number of embodiments, the keypad 116 may include keys with indexed times of day corresponding to commonly used return times, for example, noon, 6 P.M., 9 P.M., midnight, etc., as shown in FIG. 1. Alternatively, the keypad 116 may include keys for entering any time of day.

According to some of the embodiments, the keypad 116 may include a key 128 for selecting a warning lead time when actuated (step S106). As mentioned above, the warning lead time is the time at which the processor 118 causes the signal output 106 to provide a warning signal prior to the due date. For example, if the due date is noon on Wednesday and the warning lead time is 4 hours, then the processor 118 will cause the signal output to provide a warning signal at 8 A.M. on Wednesday, thereby giving the renter sufficient time to return the rented item. In a number of embodiments, the keypad 116 may include a plurality of keys 128 with indexed lead times, for example, 2 hours, 3 hours, 4 hours, etc. Alternatively, any desired warning lead time may be entered.

In still other embodiments, the keypad 116 may include one or more keys 130 for selecting a delay time (step S108). More specifically, when the warning lead time is reached and the processor 118 has caused the signal output 106 to provide a warning signal, the renter may actuate one of the delay keys 130. Upon actuation of a delay key 130, the processor 118 causes the signal output 106 to cease providing the warning signal for a period of time equal to the selected delay time. For example, if the due date is noon on Wednesday, the warning lead time is 4 hours, the signal output 106 is activated, and the selected delay time is 2 hours, then the processor 118 will turn off the signal output when the delay key 130 is actuated and will reactivate the signal output 106 again at 10 A.M. to remind the renter again of the due date.

The keypad 116 may also include a key 130 for clearing the due date. Upon actuation of the clear key 130, the alarm 100 may be reset to a default condition. In addition to the current time 112 and day 114, the display 110 may display the time 134 and the day 136 of the due date.

Figure 4:
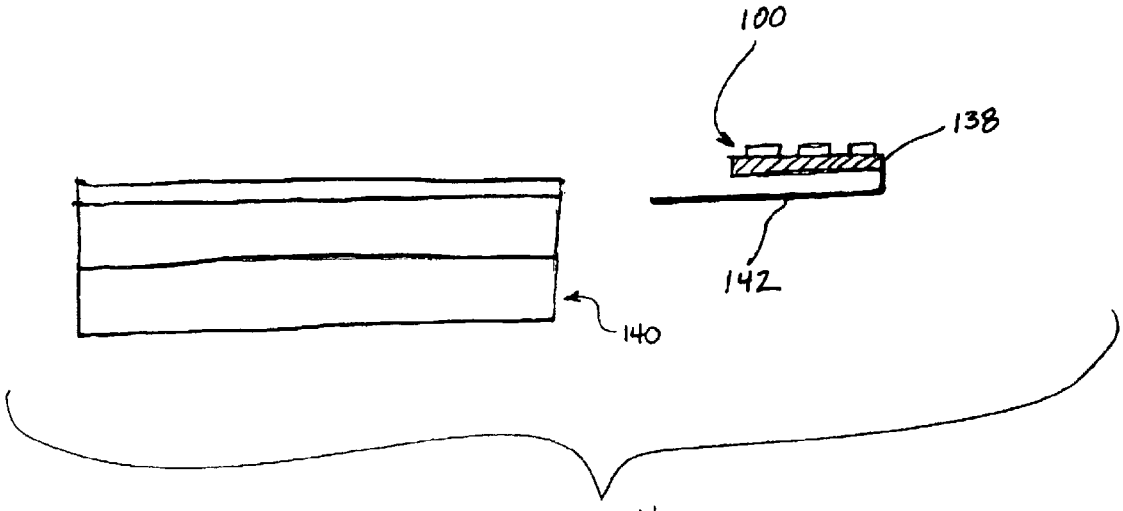
FIG. 4 is a side view of an alarm attachable to a media case.

Referring to FIG. 4, according to a number of embodiments, the alarm 100 may include a housing 138 with an attachment structure 142 for attaching the alarm 100 to a rental case 140. For example, the attachment structure 140 may include a flap 142 that is configured to slide within the clear plastic sleeve of a typical media case 140. Accordingly, the alarm 100 may be releasably engageable with a media case 140.

Figure 5:
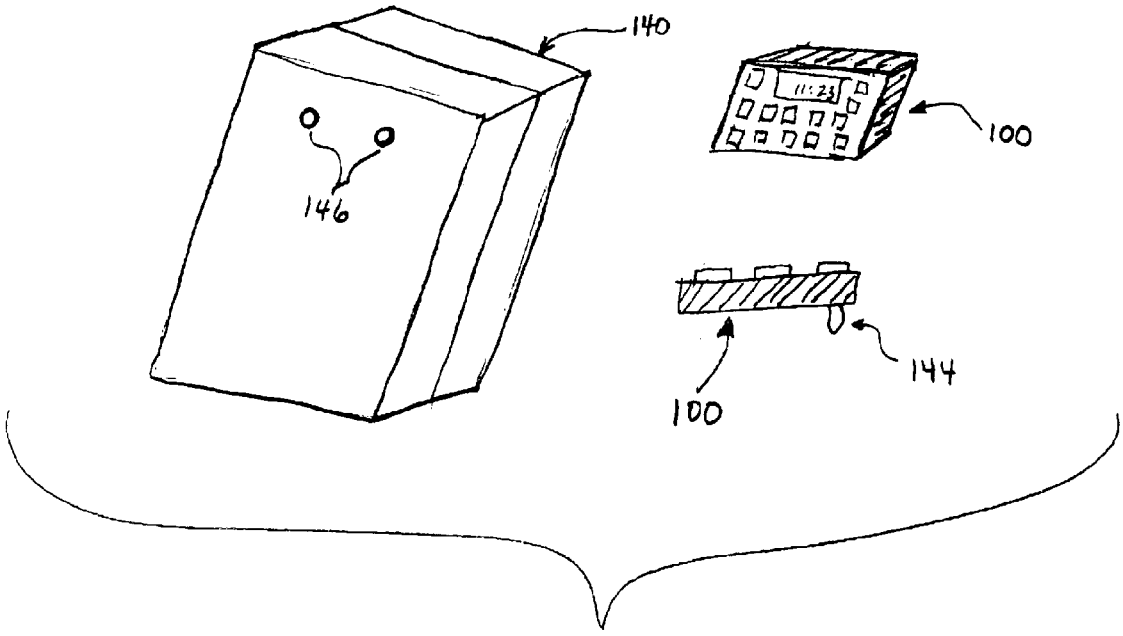
FIG. 5 is a perspective view of an attachable alarm and media case.
Figure 6:
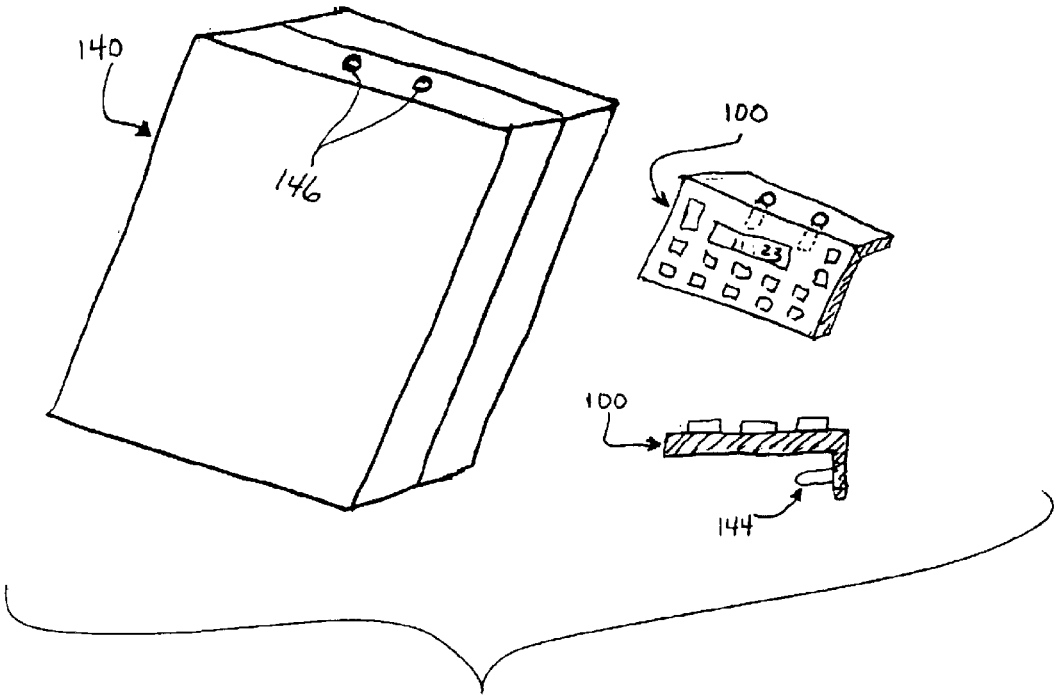
FIG. 6 is a perspective view of an attachable alarm and media case.

Alternatively, with reference to FIG. 5, the attachment structure 140 may include one or more pins 144 for engaging with complementary holes 146 formed in the media case 140. In a number of embodiments, such as shown in FIG. 6, the pins 144 may be disposed orthogonally on the housing to engage with holes 146 formed in a top of a media case 140.

Figure 7:
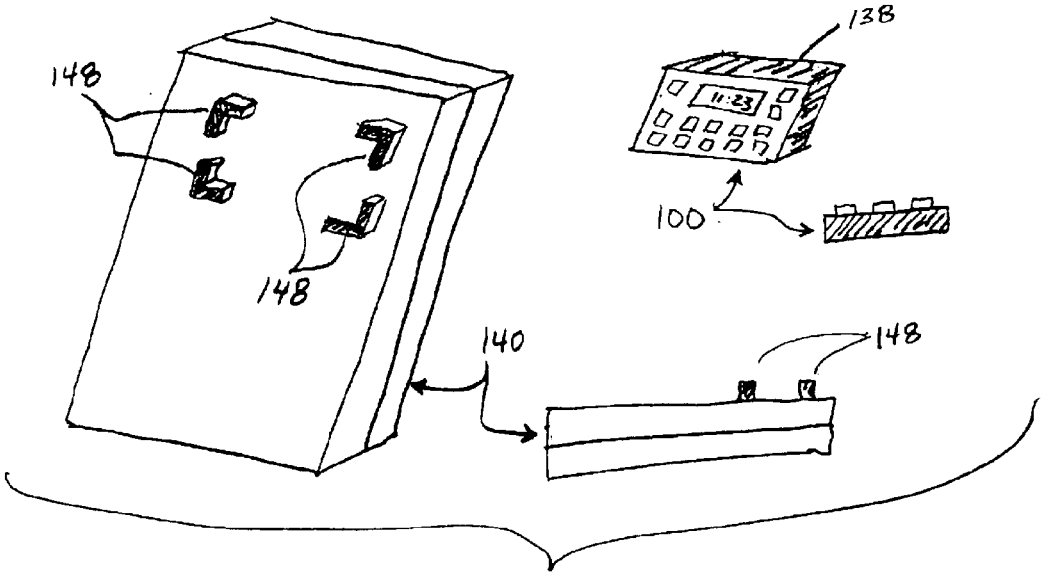
FIG. 7 is a perspective view of an attachable alarm and media case.
Figure 8:
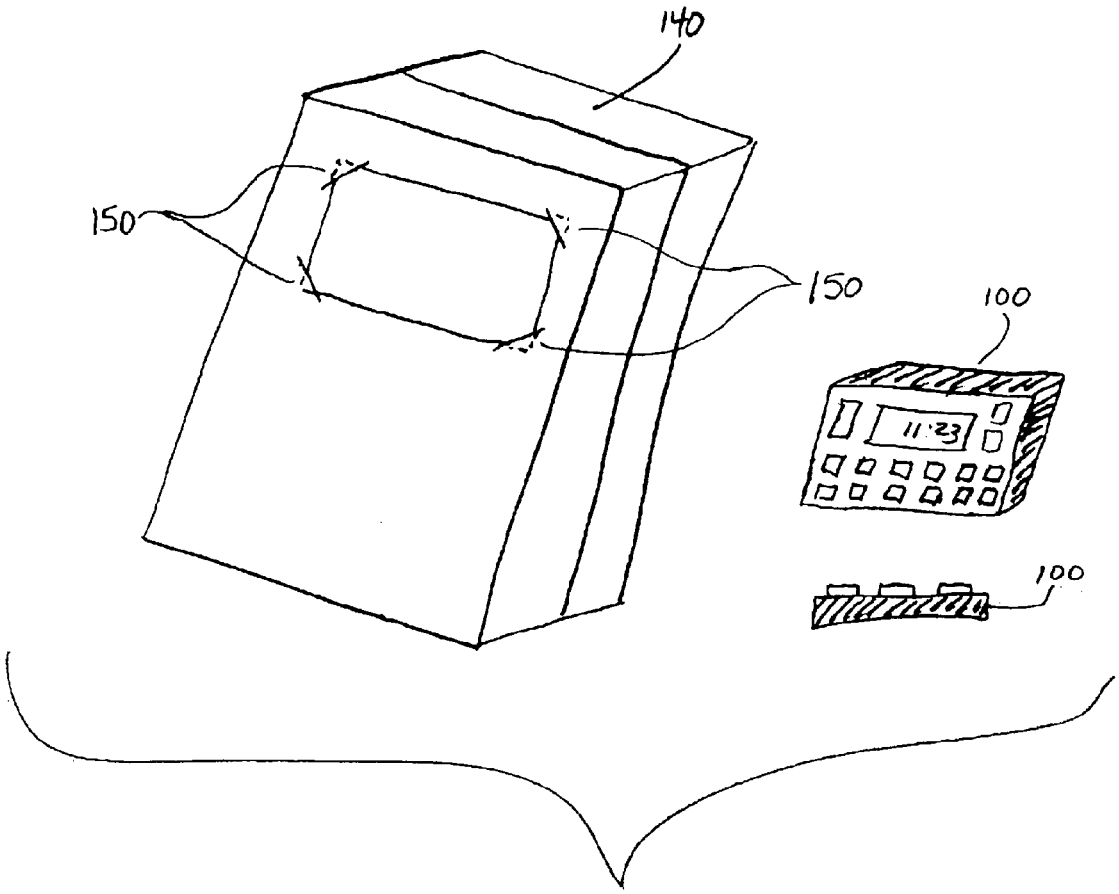
FIG. 8 is a perspective view of an attachable alarm and media case.

In other embodiments, the alarm 100 may be attached to a media case 140 by snapping the housing 138 into a set of tabs 148 disposed on the media case 140 as shown in FIG. 7. Alternatively, the alarm 100 may inserted into a plurality of slits 150 formed in the media case 140 as shown in FIG. 8.

Figure 9:
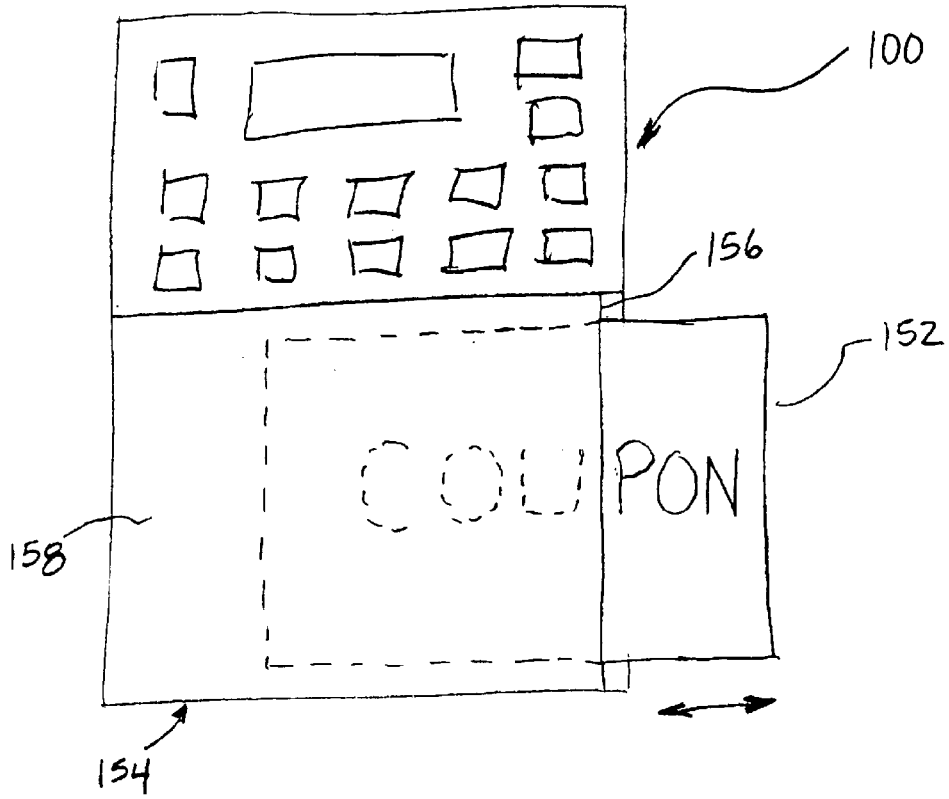
FIG. 9 is a plan view of an alarm with a printed matter pocket.
Figure 10:
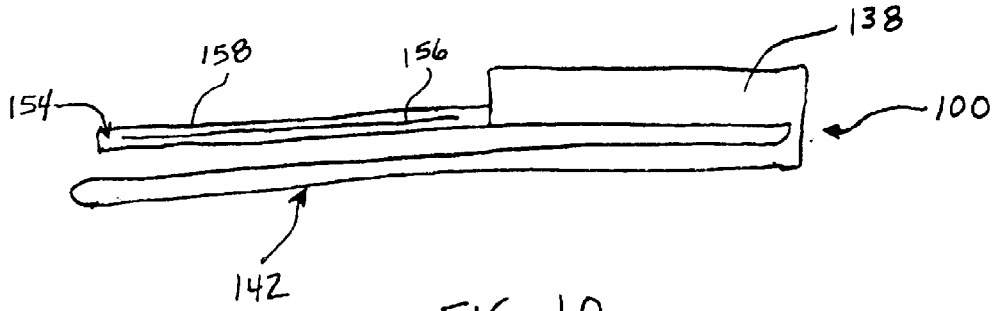
FIG. 10 is a side view of the alarm of FIG. 9.

Referencing FIGS. 9 and 10, the alarm 100 may include structure for receiving printed matter 152 such as a coupon or an advertisement. More specifically, the housing 138 may include a panel 154 with a slit 156 formed in a transparent cover 158. Accordingly, printed matter 152 may be inserted through the slit 156 to be displayed behind the cover 158.

Figure 11:
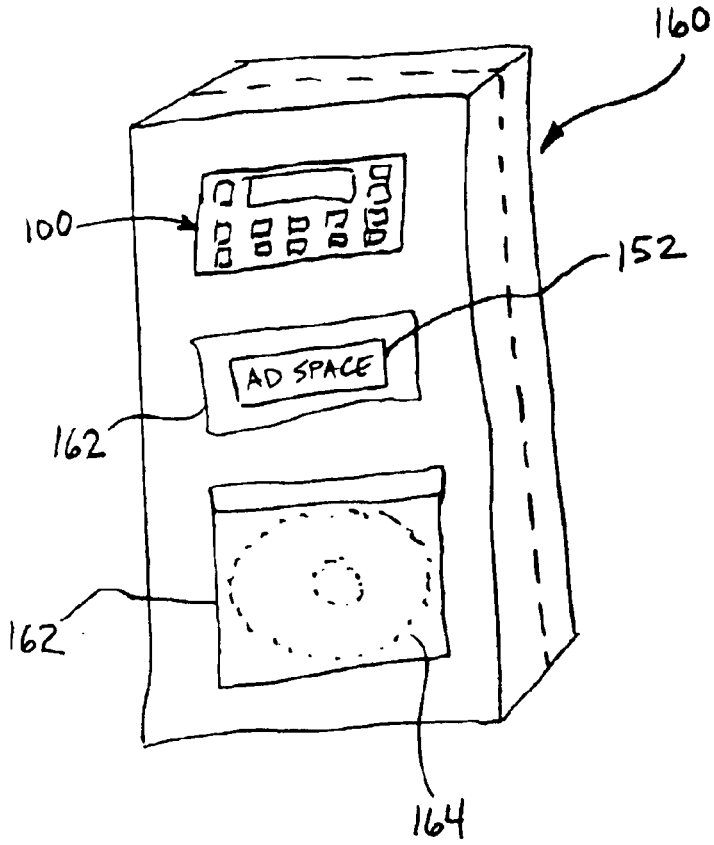
FIG. 11 is a perspective view of a media case with an alarm.
Figure 12:
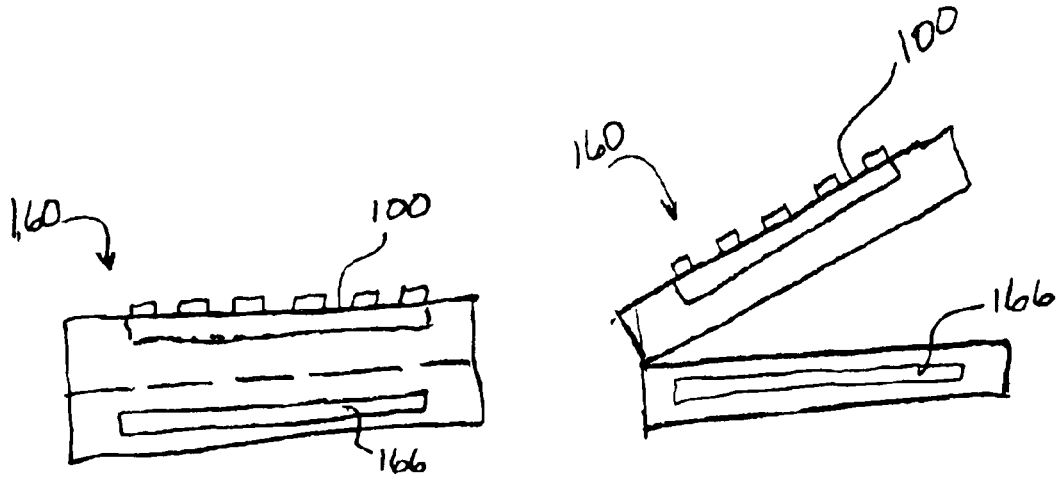
FIG. 12 is a side view of the media case of FIG. 11.

With reference to FIGS. 11 and 12, a media case 160 may include an alarm 100 fixed or integrally disposed therein. In addition, the media case 160 may include one or more pockets 162 for receiving items. For example, one of the pockets 162 may be configured to receive printed matter 152 analogous to that described above, and one of the pockets 162 may be configured to receive a promotional or supplemental DVD 164, with the desired rented DVD 166 contained within the case 160.

Figure 13:
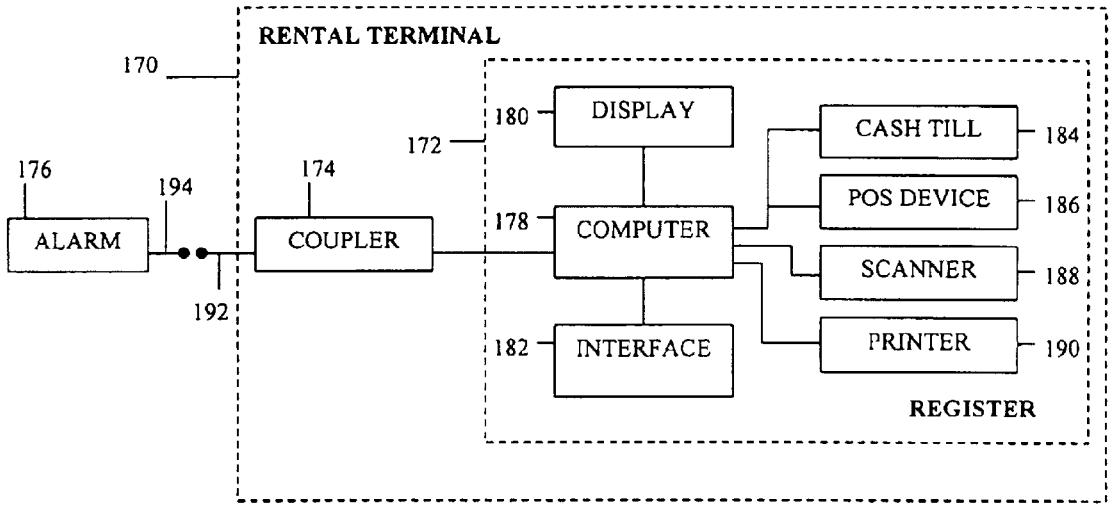
FIG. 13 is a schematic view of a terminal for a rental transaction.

With reference to FIG. 13, a terminal 170 for handling a transaction of a rental item such as a DVD may include a register 172 and a coupler 174 for providing a due date to an alarm 176. The register 172 may include a computer 178 connected to the coupler 174 and for generating a due date. The remaining components of the register 172 may include a display 180, a user interface 182 (such as a keyboard), a cash till 184, a point-of-sale (POS) device 186 for credit transactions, a scanner 188 for reading bar codes, and a printer 190 for printing receipts, advertisements, coupons, and so on. The coupler 174 may include an output interface 192 for connecting to a complementary interface or port 194 of the alarm 176.

Figure 14:
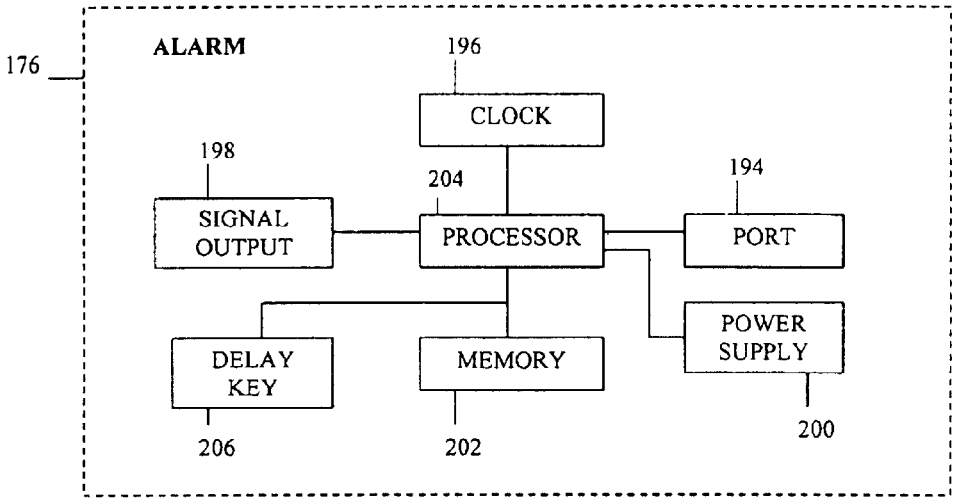
FIG. 14 is a schematic view of an alarm.

With additional reference to FIG. 14, the alarm 176 may include a clock 196, a signal output 198, a power supply 200, a memory 202 for storing the due date, and a processor 204 connected to the clock 196, the signal output 198, the power supply 200, and the memory 202. The processor 204 may be configured to cause the signal output 198 to provide a warning signal at a predetermined time prior to the due date.

During a rental transaction, the computer 178 may generate a due date automatically. Alternatively, a due date may be manually entered via the interface 182. In either case, the due date is output to the coupler 174 which, in turn, provides the due date to the alarm 176 connected via the interface 192 and 194. In addition, a warning lead time may be automatically or manually generated and provided to the alarm 172.

Figure 15:
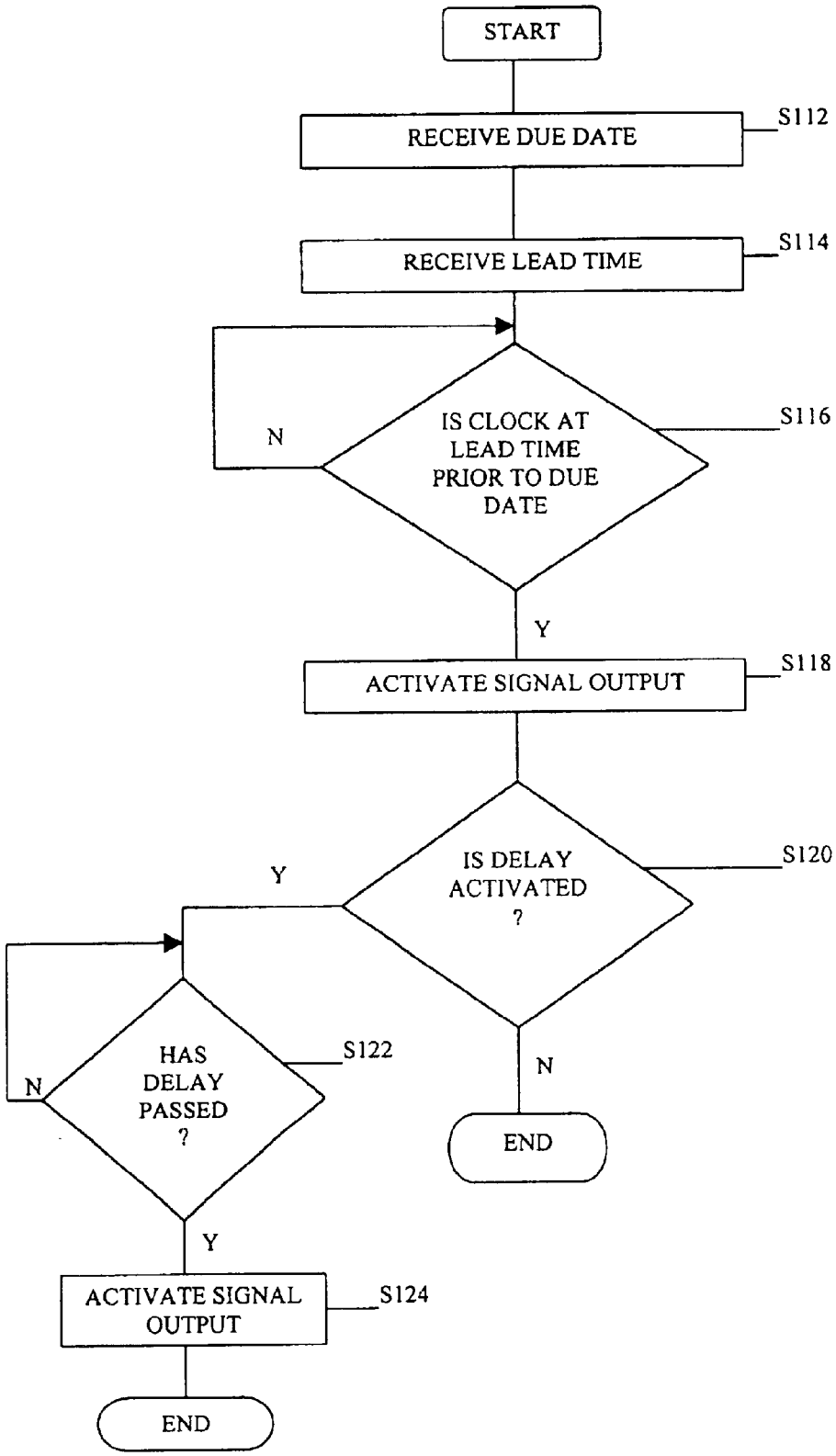
FIG. 15 is a flow chart of methodology for providing an alarm.

With reference to FIG. 15, when the due date and the warning lead time are received by the alarm 172 (steps S112 and S114), the processor 204 monitors the clock 196 to determine whether the warning lead time is reached (step S116). When the clock 196 is at the warning lead time, then the processor 204 causes the signal output 198 to provide a warning signal, either audible or visible (step S118). If a delay key 206 is activated (step S120), then the warning signal is ceased until the delay time has passed (step S122), after which time the signal output is again activated to provide a warning signal (step S124).

Those skilled in the art will understand that the preceding exemplary embodiments of the present invention provide the foundation for numerous alternatives and modifications thereto. For example, the alarm may attach to the case of the cassette or DVD directly, for example, with a clip or an elastic band, or may be free standing. Features of the alarm may include a first alarm that may be set a first period of time prior to the due date/time (e.g., six hours) and a second alarm that may be set a second period of time prior to the due date/time (e.g., four hours), and so on. These other modifications are also within the scope of the present invention. Accordingly, the present invention is not limited to that precisely as shown and described herein but rather by the appended claims.

What is claimed is:

1. An alarm for providing a warning signal prior to a due date of a rental item, the alarm comprising:

a clock;

a memory;

a signal output;

a power supply;

a display for showing the time and the day of the week;

a keypad including:

a key for initiating a due-date sequence;

a key for selecting a day of the week of the due date;

a key for selecting a time of day of the due date; and a key for selecting a warning lead time;

a processor connected to the clock, the memory, the signal output, the power supply, the display, and the keypad;

the processor for causing the due date and the warning lead time to be stored in the memory and for causing the signal output to provide a warning signal prior to the due date at a time equal to the warning lead time.

2. An alarm as claimed in claim 1 wherein the processor causes the display to show the due date.

3. An alarm as claimed in claim 1 wherein the keypad includes a plurality of keys for selecting a respective day of the week of the due date.

4. An alarm as claimed in claim 1 wherein the keypad includes a plurality of keys for selecting a respective time of day of the due date.

5. An alarm as claimed in claim 1 wherein the keypad includes a plurality of keys for selecting a respective warning lead time.

6. An alarm as claimed in claim 1 wherein the keypad further includes a key for selecting a delay time.

7. An alarm as claimed in claim 6 wherein the keypad includes a plurality of keys for selecting a respective delay time.

8. An alarm as claimed in claim 1 wherein the keypad further includes a key for clearing the due date.

9. An alarm as claimed in claim 1 wherein the signal output provides an audible warning signal.

10. An alarm as claimed in claim 1 further comprising a housing including an attachment structure for attaching the alarm to a rental case.

11. An alarm as claimed in claim 10 wherein the attachment structure include a flap.

12. An alarm as claimed in claim 10 further comprising a pocket disposed on the housing.

13. An alarm for providing a warning signal at a predetermined time prior to a due date of a rental item, the alarm comprising:

a clock;

a signal output;

a power supply;

a memory for storing the due date;

a processor connected to the clock, the signal output, the power supply, and the memory;

the processor for causing the signal output to provide a warning signal at the predetermined time prior to the due date.

14. An alarm as claimed in claim 13 further comprising an input operatively connected to the memory for receiving the due date from a remote device.

15. An alarm as claimed in claim 13 further comprising a user interface operatively connected to the memory for providing the due date.

16. An alarm as claimed in claim 15 wherein the user interface includes a keypad.

17. An alarm as claimed in claim 13 further comprising a display.

18. A method for providing a warning signal prior to a due date of a rental item, the method comprising:

providing an alarm including:

a clock;

a memory;

a signal output;

a power supply;

a display for showing the time and the day of the week;

a keypad including:

a key for initiating a due-date sequence;

a key for selecting a day of the week of the due date;

a key for selecting a time of day of the due date; and a key for selecting a warning lead time;

a processor connected to the clock, the memory, the signal output, the power supply, the display, and the keypad, the processor for causing the due date and the warning lead time to be stored in the memory and for causing the signal output to provide a warning signal prior to the due date at a time equal to the warning lead time;

pressing the key for initiating a due-date sequence;

selecting a day of the week of the due date;

selecting a time of day of the due date; and selecting a warning lead time.

19. A method as claimed in claim 18 wherein the keypad further includes a key for selecting a delay time;

the method further comprising pressing a delay key on the alarm when the signal output is providing a warning signal.

20. A method for providing a warning signal prior to a due date of a rental item, the method comprising:

receiving a due date including a time and a day;

receiving a warning lead time; and providing a warning signal at a time prior to the due date substantially equal to the warning lead time.

21. A method as claimed in claim 20 further comprising:

receiving a delay time when providing the warning signal.

22. A method as claimed in claim 21 further comprising:

providing a warning signal after waiting a period of time substantially equal to the delay time.

23. In combination, a rental item and an alarm for providing a warning signal at a predetermined time prior to a due date of the rental item, the combination comprising:

a rental item including a case; and an alarm including:

a clock;

a signal output;

a power supply;

a memory for storing the due date;

a processor connected to the clock, the signal output, the power supply, and the memory, the processor for causing the signal output to provide a warning signal at the predetermined time prior to the due date; and a housing including attachment structure for attaching the alarm to the case of the rental item.

24. A device for holding a rental item, the device comprising:

a case; and an alarm disposed on the case and for providing a warning signal prior to a due date of the rental item, the alarm including:

a clock;

a memory;

a signal output;

a power supply;

a display for showing the time and the day of the week;

a keypad including:

a key for initiating a due-date sequence;

a key for selecting a day of the week of the due date;

a key for selecting a time of day of the due date; and a key for selecting a warning lead time;

a processor connected to the clock, the memory, the signal output, the power supply, the display, and the keypad;

the processor for causing the due date and the warning lead time to be stored in the memory and for causing the signal output to provide a warning signal prior to the due date at a time equal to the warning lead time.

25. A device as claimed in claim 24 further comprising media disposed in the case.

26. A device as claimed in claim 25 wherein the media includes a DVD.

27. A device as claimed in claim 24 wherein the alarm is releasably attached to the case.

28. A device as claimed in claim 24 wherein the alarm is integral with the case.

29. A terminal for handling a transaction of a rental item, the terminal comprising:

a register including a computer for generating a due date;

a coupler connected to the computer and including an output interface; and the coupler for receiving the due date and for providing the due date to the alarm;

an alarm for providing a warning signal prior to a due date of the rental item, the alarm including:

a clock;

a signal output;

a power supply;

a memory for storing the due date;

a processor connected to the clock, the signal output, the power supply, and the memory;

the processor for causing the signal output to provide a warning signal at the predetermined time prior to the due date.

30. A device as claimed in claim 29 wherein the alarm includes a housing with a pocket.

31. A device as claimed in claim 30 the register includes a printer for printing a coupon that is insertable into the pocket of the housing of the alarm.

* * * * *